US009277788B2

(12) United States Patent
Humbert et al.

(10) Patent No.: US 9,277,788 B2
(45) Date of Patent: Mar. 8, 2016

(54) DUAL RELEASE BUCKLE ASSEMBLIES AND ASSOCIATED SYSTEMS AND METHODS

(71) Applicant: AmSafe, Inc., Phoenix, AZ (US)

(72) Inventors: Todd J. Humbert, Chandler, AZ (US); David T. Merrill, Scottsdale, AZ (US)

(73) Assignee: AmSafe, Inc., Phoenix, AZ (US)

( * ) Notice: Subject to any disclaimer, the term of this patent is extended or adjusted under 35 U.S.C. 154(b) by 67 days.

(21) Appl. No.: 14/183,489

(22) Filed: Feb. 18, 2014

(65) Prior Publication Data

US 2014/0230201 A1 Aug. 21, 2014

Related U.S. Application Data

(60) Provisional application No. 61/766,683, filed on Feb. 19, 2013.

(51) Int. Cl.
*A44B 11/25* (2006.01)

(52) U.S. Cl.
CPC ..... *A44B 11/2569* (2013.01); *A44B 11/2542* (2013.01); *Y10T 24/45634* (2015.01)

(58) Field of Classification Search
CPC ..... Y10T 24/45613; Y10T 24/45618; Y10T 24/45628; Y10T 24/45634; A44B 11/2542; A44B 11/2569; B60R 2022/027
See application file for complete search history.

(56) References Cited

U.S. PATENT DOCUMENTS

| | | | |
|---|---|---|---|
| 906,045 | A | 12/1908 | Miller |
| 1,079,080 | A | 11/1913 | Ward |
| 1,369,456 | A | 2/1922 | Meredith |
| 1,438,898 | A | 12/1922 | Carpmill |
| 1,816,262 | A | 7/1931 | Ritter |
| 1,930,378 | A | 10/1933 | Beagan |
| 2,132,556 | A | 10/1938 | Blackshaw |
| 2,372,557 | A | 3/1945 | Dowd |
| 2,437,585 | A | 3/1948 | Zimmern |
| 2,482,693 | A | 9/1949 | Rogers et al. |

(Continued)

FOREIGN PATENT DOCUMENTS

| | | |
|---|---|---|
| CA | 2038505 | 9/1991 |
| CA | 2091526 | 10/1993 |

(Continued)

OTHER PUBLICATIONS

Britax, "COMPAQ: Convertible Car Seats." Buckle Image. Accessed Oct. 12, 2010. (2 pages). This has been publicly available for at least one year prior to this application's filing date.

(Continued)

*Primary Examiner* — Robert J Sandy
*Assistant Examiner* — Rowland Do
(74) *Attorney, Agent, or Firm* — Perkins Coie LLP

(57) ABSTRACT

Buckle assemblies with dual release features and associated systems and methods are disclosed herein. In one embodiment, a buckle assembly is configured to detachably engage latch plates. The buckle assembly can include a top cover and a bottom housing collectively defining an operation space; a load plate having a plurality of apertures, an actuator configured to connect with the top cover, a plurality of pawls configured to operably enter the corresponding apertures so as to secure a plurality of latch plates, a release ring positioned adjacent to the pawls and connected with a release cord. The latch plates can be released by rotating the top cover or pulling the release cord.

12 Claims, 4 Drawing Sheets

(56) References Cited

U.S. PATENT DOCUMENTS 2,538,641 A 1/1951 Elsner
2,549,841 A 4/1951 Morrow et al.
2,639,852 A 5/1953 Sanders et al.
2,641,813 A 6/1953 Loxham
2,710,999 A 6/1955 Davis
2,763,451 A 9/1956 Moran
2,803,864 A 8/1957 Bishaf
2,845,233 A 7/1958 Wrighton
2,846,745 A 8/1958 Lathrop
2,869,200 A 1/1959 Phillips et al.
2,876,516 A 3/1959 Cummings
2,892,232 A 6/1959 Quilter
2,893,088 A 7/1959 Harper et al.
2,899,732 A 8/1959 Cushman
2,901,794 A 9/1959 Prete, Jr.
2,921,353 A * 1/1960 Cushman ..... 24/632
2,938,254 A 5/1960 Gaylord
2,964,815 A 12/1960 Sereno
2,965,942 A 12/1960 Carter
3,029,487 A 4/1962 Asai
3,034,596 A * 5/1962 Twaits, Jr. ..... 182/3
3,084,411 A 4/1963 Lindblad
3,091,010 A 5/1963 Davis
3,104,440 A 9/1963 Davis
3,110,071 A 11/1963 Higuchi
3,118,208 A 1/1964 Wexler
3,132,399 A * 5/1964 Cooper ..... 24/632
3,137,907 A 6/1964 Unai
D198,566 S 7/1964 Holmberg et al.
3,142,103 A 7/1964 Lindblad
3,145,442 A 8/1964 Brown
3,165,805 A 1/1965 Lower
3,178,226 A 4/1965 Lorwin
3,179,992 A 4/1965 Murphy, Sr.
3,183,568 A 5/1965 Gaylord
3,189,963 A 6/1965 Warner et al.
3,218,685 A 11/1965 Atumi
3,226,791 A 1/1966 Carter
3,233,941 A 2/1966 Selzer
3,256,576 A 6/1966 Klove, Jr. et al.
3,262,169 A 7/1966 Jantzen
3,287,062 A 11/1966 Board
3,289,261 A 12/1966 Davis
3,293,713 A 12/1966 Gaylord
3,306,662 A 2/1967 Finnigan
3,312,502 A 4/1967 Coe
3,369,842 A 2/1968 Adams et al.
3,380,776 A 4/1968 Dillender
3,414,947 A 12/1968 Holmberg et al.
3,428,029 A 2/1969 Klickstein
3,451,720 A 6/1969 Makinen
3,473,201 A * 10/1969 Hopka et al. ..... 24/632
3,491,414 A 1/1970 Stoffel
3,505,711 A 4/1970 Carter
3,523,342 A 8/1970 Spires
D218,589 S 9/1970 Lohr et al.
3,564,672 A 2/1971 McIntyre
3,576,056 A 4/1971 Barcus
3,591,900 A 7/1971 Brown
3,605,207 A 9/1971 Glauser et al.
3,605,210 A 9/1971 Lohr
3,631,571 A 1/1972 Stoffel
3,639,948 A 2/1972 Sherman
3,644,967 A 2/1972 Romanzi, Jr. et al.
3,648,333 A 3/1972 Stoffel
3,658,281 A 4/1972 Gaylord
3,673,645 A 7/1972 Burleigh et al.
3,678,542 A 7/1972 Prete, Jr.
3,695,696 A 10/1972 Lohr et al.
3,714,684 A 2/1973 Gley
3,744,102 A 7/1973 Gaylord
3,744,103 A 7/1973 Gaylord
3,747,167 A * 7/1973 Pravaz ..... 24/573.11
3,760,464 A 9/1973 Higuchi
3,766,611 A 10/1973 Gaylord
3,766,612 A 10/1973 Hattori
3,775,813 A 12/1973 Higuchi
3,825,979 A 7/1974 Jakob
3,827,716 A 8/1974 Vaughn et al.
3,856,351 A 12/1974 Garveys
3,879,810 A 4/1975 Prete, Jr. et al.
3,898,715 A 8/1975 Balder et al.
3,935,618 A 2/1976 Fohl et al.
3,964,138 A 6/1976 Gaylord
3,986,234 A 10/1976 Frost et al.
3,995,885 A 12/1976 Plesniarski
4,018,399 A 4/1977 Rex
4,026,245 A 5/1977 Arthur
4,051,743 A 10/1977 Gaylord
4,095,313 A 6/1978 Piljay et al.
D248,618 S 7/1978 Anthony
4,100,657 A 7/1978 Minolla et al.
4,118,833 A 10/1978 Knox et al.
4,128,924 A 12/1978 Happel et al.
4,136,422 A 1/1979 Ivanov et al.
4,148,224 A 4/1979 Craig
4,181,832 A 1/1980 Ueda et al.
4,184,234 A 1/1980 Anthony et al.
4,185,363 A 1/1980 David
4,196,500 A 4/1980 Happel et al.
4,220,294 A 9/1980 DiPaola
4,228,567 A 10/1980 Ikesue et al.
4,239,260 A 12/1980 Hollowell
4,253,623 A 3/1981 Steger et al.
4,262,396 A 4/1981 Koike et al.
4,273,301 A 6/1981 Frankila
4,302,049 A 11/1981 Simpson
4,317,263 A 3/1982 Fohl et al.
4,321,734 A 3/1982 Gandelman
4,334,341 A 6/1982 Krautz et al.
4,336,636 A 6/1982 Ishiguro et al.
4,366,604 A 1/1983 Anthony et al.
4,385,425 A 5/1983 Tanaka et al.
4,408,374 A 10/1983 Fohl et al.
4,419,874 A 12/1983 Brentini et al.
4,425,688 A 1/1984 Anthony et al.
4,457,052 A 7/1984 Hauber
4,487,454 A 12/1984 Biller
4,491,343 A 1/1985 Fohl et al.
4,525,901 A 7/1985 Krauss
4,545,097 A 10/1985 Wier et al.
4,549,769 A 10/1985 Pilarski
4,555,831 A 12/1985 Otzen et al.
4,569,535 A 2/1986 Haglund et al.
D285,383 S 9/1986 Anthony
4,617,705 A 10/1986 Anthony et al.
4,637,102 A 1/1987 Teder et al.
4,638,533 A 1/1987 Gloomis et al.
4,640,550 A 2/1987 Hakansson et al.
4,644,618 A 2/1987 Holmberg et al.
4,646,400 A 3/1987 Tanaka et al.
4,648,483 A 3/1987 Skyba
4,650,214 A 3/1987 Higbee
4,651,946 A 3/1987 Anthony et al.
4,656,700 A 4/1987 Tanaka et al.
4,660,889 A 4/1987 Anthony et al.
4,679,852 A 7/1987 Anthony et al.
4,682,791 A 7/1987 Ernst et al.
4,685,176 A 8/1987 Burnside et al.
4,692,970 A 9/1987 Anthony et al.
4,711,003 A 12/1987 Gelula
4,716,630 A 1/1988 Skyba
4,720,148 A 1/1988 Anthony et al.
4,726,625 A 2/1988 Bougher
4,727,628 A 3/1988 Rudholm et al.
4,733,444 A 3/1988 Takada
4,738,485 A 4/1988 Rumpf
4,741,574 A 5/1988 Weightman et al.
4,742,604 A 5/1988 Mazelsky
D296,678 S 7/1988 Lortz et al.
4,757,579 A 7/1988 Nishino et al.
4,758,048 A 7/1988 Shuman
4,766,654 A 8/1988 Sugimoto
4,786,078 A 11/1988 Schreier et al.

(56) References Cited

U.S. PATENT DOCUMENTS

| | | | |
|---|---|---|---|
| 4,786,080 | A | 11/1988 | Jay |
| 4,790,597 | A | 12/1988 | Bauer et al. |
| 4,809,409 | A | 3/1989 | Van Riesen et al. |
| 4,832,410 | A | 5/1989 | Bougher |
| 4,843,688 | A | 7/1989 | Ikeda et al. |
| 4,854,607 | A | 8/1989 | Mandracchia et al. |
| 4,854,608 | A | 8/1989 | Barral et al. |
| D303,232 | S | 9/1989 | Lortz et al. |
| 4,876,770 | A | 10/1989 | Bougher |
| 4,876,772 | A | 10/1989 | Anthony et al. |
| 4,884,652 | A | 12/1989 | Vollmer |
| 4,901,407 | A | 2/1990 | Pandola et al. |
| 4,903,377 | A | 2/1990 | Doty |
| 4,911,377 | A | 3/1990 | Lortz et al. |
| 4,919,484 | A | 4/1990 | Bougher et al. |
| 4,927,211 | A | 5/1990 | Bolcerek |
| 4,934,030 | A | 6/1990 | Spinosa et al. |
| 4,940,254 | A | 7/1990 | Ueno et al. |
| 4,942,649 | A | 7/1990 | Anthony et al. |
| 4,995,640 | A | 2/1991 | Saito et al. |
| 5,015,010 | A | 5/1991 | Homeier et al. |
| 5,023,981 | A | 6/1991 | Anthony et al. |
| 5,026,093 | A | 6/1991 | Nishikaji |
| 5,029,369 | A | 7/1991 | Oberhardt et al. |
| 5,031,962 | A | 7/1991 | Lee |
| 5,038,446 | A | 8/1991 | Anthony et al. |
| 5,039,169 | A | 8/1991 | Bougher et al. |
| 5,046,687 | A | 9/1991 | Herndon |
| 5,050,274 | A | 9/1991 | Staniszewski et al. |
| 5,054,815 | A | 10/1991 | Gavagan |
| 5,058,244 | A | 10/1991 | Fernandez |
| 5,067,212 | A | 11/1991 | Ellis |
| 5,074,011 | A | 12/1991 | Carlson |
| 5,074,588 | A | 12/1991 | Huspen |
| 5,084,946 | A | 2/1992 | Lee |
| 5,088,160 | A | 2/1992 | Warrick |
| 5,088,163 | A | 2/1992 | van Riesen et al. |
| 5,097,572 | A | 3/1992 | Warrick |
| D327,455 | S | 6/1992 | Blair |
| 5,119,532 | A | 6/1992 | Tanaka et al. |
| 5,123,147 | A | 6/1992 | Blair |
| 5,123,673 | A | 6/1992 | Tame |
| 5,142,748 | A | 9/1992 | Anthony et al. |
| 5,159,732 | A | 11/1992 | Burke et al. |
| 5,160,186 | A | 11/1992 | Lee |
| 5,165,149 | A | 11/1992 | Nihei |
| 5,170,539 | A | 12/1992 | Lundstedt et al. |
| D332,433 | S | 1/1993 | Bougher |
| 5,176,402 | A | 1/1993 | Coulon |
| 5,182,837 | A | 2/1993 | Anthony et al. |
| 5,219,206 | A | 6/1993 | Anthony et al. |
| 5,219,207 | A | 6/1993 | Anthony et al. |
| 5,220,713 | A | 6/1993 | Lane, Jr. et al. |
| D338,119 | S | 8/1993 | Merrick |
| 5,234,181 | A | 8/1993 | Schroth et al. |
| 5,236,220 | A | 8/1993 | Mills |
| 5,248,187 | A | 9/1993 | Harrison |
| D342,465 | S | 12/1993 | Anthony et al. |
| 5,267,377 | A | 12/1993 | Gillis et al. |
| 5,269,051 | A | 12/1993 | McFalls |
| 5,272,770 | A | 12/1993 | Allen et al. |
| 5,282,672 | A | 2/1994 | Borlinghaus |
| 5,282,706 | A | 2/1994 | Anthony et al. |
| 5,283,933 | A | 2/1994 | Wiseman et al. |
| 5,286,057 | A | 2/1994 | Forster |
| 5,286,090 | A | 2/1994 | Templin et al. |
| 5,292,181 | A | 3/1994 | Dybro |
| 5,301,371 | A | 4/1994 | Chao |
| 5,308,148 | A | 5/1994 | Peterson et al. |
| 5,311,653 | A | 5/1994 | Merrick |
| 5,332,968 | A | 7/1994 | Brown |
| 5,350,195 | A | 9/1994 | Brown |
| 5,350,196 | A | 9/1994 | Atkins |
| 5,369,855 | A | 12/1994 | Tokugawa et al. |
| 5,370,333 | A | 12/1994 | Lortz et al. |
| 5,375,879 | A | 12/1994 | Williams et al. |
| 5,380,066 | A | 1/1995 | Wiseman et al. |
| 5,392,535 | A | 2/1995 | Van Noy et al. |
| 5,397,171 | A | 3/1995 | Leach |
| 5,403,038 | A | 4/1995 | McFalls |
| 5,406,681 | A | 4/1995 | Olson et al. |
| 5,411,292 | A | 5/1995 | Collins et al. |
| 5,416,957 | A | 5/1995 | Renzi, Sr. et al. |
| D359,710 | S | 6/1995 | Chinni et al. |
| 5,432,987 | A | 7/1995 | Schroth |
| 5,435,272 | A | 7/1995 | Epstein |
| 5,443,302 | A | 8/1995 | Dybro |
| 5,451,094 | A | 9/1995 | Templin et al. |
| D364,124 | S | 11/1995 | Lortz et al. |
| 5,471,714 | A | 12/1995 | Olson et al. |
| 5,495,646 | A | 3/1996 | Scrutchfield et al. |
| 5,497,956 | A | 3/1996 | Crook |
| 5,511,856 | A | 4/1996 | Merrick et al. |
| 5,516,199 | A | 5/1996 | Crook et al. |
| 5,526,556 | A | 6/1996 | Czank |
| 5,540,403 | A | 7/1996 | Standley |
| 5,560,565 | A | 10/1996 | Merrick et al. |
| 5,561,891 | A | 10/1996 | Hsieh et al. |
| 5,566,431 | A | 10/1996 | Haglund |
| 5,568,676 | A | 10/1996 | Freeman |
| 5,570,933 | A | 11/1996 | Rouhana et al. |
| 5,579,785 | A | 12/1996 | Bell |
| 5,584,107 | A | 12/1996 | Koyanagi et al. |
| 5,588,189 | A | 12/1996 | Gorman et al. |
| 5,606,783 | A | 3/1997 | Gillis et al. |
| 5,622,327 | A | 4/1997 | Heath et al. |
| 5,628,548 | A | 5/1997 | Lacoste |
| 5,634,664 | A | 6/1997 | Seki et al. |
| 5,640,468 | A | 6/1997 | Hsu |
| 5,669,572 | A | 9/1997 | Crook |
| 5,695,243 | A | 12/1997 | Anthony et al. |
| 5,699,594 | A | 12/1997 | Czank et al. |
| D389,426 | S | 1/1998 | Merrick et al. |
| 5,722,689 | A | 3/1998 | Chen et al. |
| 5,743,597 | A | 4/1998 | Jessup et al. |
| 5,765,774 | A | 6/1998 | Maekawa et al. |
| 5,774,947 | A | 7/1998 | Anscher |
| 5,779,319 | A | 7/1998 | Merrick |
| D397,063 | S | 8/1998 | Woellert et al. |
| 5,788,281 | A | 8/1998 | Yanagi et al. |
| 5,788,282 | A | 8/1998 | Lewis |
| 5,794,878 | A | 8/1998 | Carpenter et al. |
| 5,806,148 | A | 9/1998 | McFalls et al. |
| 5,813,097 | A | 9/1998 | Woellert et al. |
| 5,839,793 | A | 11/1998 | Merrick et al. |
| 5,857,247 | A | 1/1999 | Warrick et al. |
| 5,873,599 | A | 2/1999 | Bauer et al. |
| 5,873,635 | A | 2/1999 | Merrick |
| 5,882,084 | A | 3/1999 | Verellen et al. |
| D407,667 | S | 4/1999 | Homeier |
| 5,908,223 | A | 6/1999 | Miller |
| 5,915,630 | A | 6/1999 | Step |
| 5,934,760 | A | 8/1999 | Schroth et al. |
| D416,827 | S | 11/1999 | Anthony et al. |
| 5,979,026 | A | 11/1999 | Anthony |
| 5,979,982 | A | 11/1999 | Nakagawa |
| 5,996,192 | A | 12/1999 | Haines et al. |
| 6,003,899 | A | 12/1999 | Chaney |
| 6,017,087 | A | 1/2000 | Anthony et al. |
| 6,056,320 | A | 5/2000 | Khalifa et al. |
| 6,065,367 | A | 5/2000 | Schroth et al. |
| 6,065,777 | A | 5/2000 | Merrick |
| 6,123,388 | A | 9/2000 | Vits et al. |
| 6,182,783 | B1 | 2/2001 | Bayley |
| RE37,123 | E | 4/2001 | Templin et al. |
| 6,224,154 | B1 | 5/2001 | Stoki |
| 6,230,370 | B1 | 5/2001 | Nelsen |
| 6,260,884 | B1 | 7/2001 | Bittner et al. |
| 6,295,700 | B1 | 10/2001 | Plzak |
| 6,309,024 | B1 | 10/2001 | Busch |
| 6,312,015 | B1 | 11/2001 | Merrick et al. |
| 6,315,232 | B1 | 11/2001 | Merrick |
| 6,322,140 | B1 | 11/2001 | Jessup et al. |
| 6,322,149 | B1 | 11/2001 | Conforti et al. |

(56) References Cited

U.S. PATENT DOCUMENTS

| | | | |
|---|---|---|---|
| 6,325,412 | B1 | 12/2001 | Pan et al. |
| 6,328,379 | B1 | 12/2001 | Merrick et al. |
| 6,343,841 | B1 | 2/2002 | Gregg et al. |
| 6,351,717 | B2 | 2/2002 | Lambrecht |
| 6,357,790 | B1 | 3/2002 | Swann et al. |
| 6,358,591 | B1 | 3/2002 | Smith |
| 6,363,591 | B1 | 4/2002 | Bell et al. |
| 6,367,882 | B1 | 4/2002 | Van Druff et al. |
| 6,374,168 | B1 | 4/2002 | Fujii |
| 6,400,145 | B1 | 6/2002 | Chamings et al. |
| 6,412,863 | B1 | 7/2002 | Merrick et al. |
| 6,418,596 | B2 | 7/2002 | Haas et al. |
| 6,425,632 | B1 | 7/2002 | Anthony et al. |
| 6,442,807 | B1 | 9/2002 | Adkisson |
| 6,446,272 | B1 | 9/2002 | Lee et al. |
| 6,463,638 | B1 | 10/2002 | Pontaoe |
| 6,467,849 | B1 | 10/2002 | Deptolla et al. |
| 6,485,057 | B1 | 11/2002 | Midorikawa et al. |
| 6,485,098 | B1 | 11/2002 | Vits et al. |
| 6,508,515 | B2 | 1/2003 | Vits et al. |
| 6,513,208 | B1 | 2/2003 | Sack et al. |
| 6,520,392 | B2 | 2/2003 | Thibodeau et al. |
| 6,543,101 | B2 | 4/2003 | Sack et al. |
| 6,547,273 | B2 | 4/2003 | Grace et al. |
| 6,560,825 | B2 | 5/2003 | Maciejczyk et al. |
| 6,566,869 | B2 | 5/2003 | Chamings et al. |
| 6,588,077 | B2 | 7/2003 | Katsuyama et al. |
| 6,592,149 | B2 | 7/2003 | Sessoms |
| 6,606,770 | B1 | 8/2003 | Badrenas Buscart |
| 6,619,753 | B2 | 9/2003 | Takayama |
| 6,631,926 | B2 | 10/2003 | Merrick et al. |
| 6,665,912 | B2 | 12/2003 | Turner et al. |
| 6,694,577 | B2 | 2/2004 | Di Perrero et al. |
| 6,711,790 | B2 | 3/2004 | Pontaoe |
| 6,719,233 | B2 | 4/2004 | Specht et al. |
| 6,719,326 | B2 | 4/2004 | Schroth et al. |
| 6,722,601 | B2 | 4/2004 | Kohlndorfer et al. |
| 6,722,697 | B2 | 4/2004 | Krauss et al. |
| 6,733,041 | B2 | 5/2004 | Arnold et al. |
| 6,739,541 | B2 | 5/2004 | Palliser et al. |
| 6,749,150 | B2 | 6/2004 | Kohlndorfer et al. |
| 6,763,557 | B2 | 7/2004 | Steiff et al. |
| 6,769,157 | B1 | 8/2004 | Meal |
| 6,786,294 | B2 | 9/2004 | Specht et al. |
| 6,786,510 | B2 | 9/2004 | Roychoudhury et al. |
| 6,786,511 | B2 | 9/2004 | Heckmayr et al. |
| 6,793,291 | B1 | 9/2004 | Kocher |
| 6,796,007 | B1 | 9/2004 | Anscher |
| 6,802,470 | B2 | 10/2004 | Smithson et al. |
| 6,820,310 | B2 | 11/2004 | Woodard et al. |
| 6,820,902 | B2 | 11/2004 | Kim |
| 6,834,822 | B2 | 12/2004 | Koning et al. |
| 6,836,754 | B2 | 12/2004 | Cooper |
| 6,837,519 | B2 | 1/2005 | Moskalik et al. |
| 6,840,544 | B2 | 1/2005 | Prentkowski |
| 6,851,160 | B2 | 2/2005 | Carver |
| 6,857,326 | B2 | 2/2005 | Specht et al. |
| 6,860,671 | B2 | 3/2005 | Schulz |
| 6,863,235 | B2 | 3/2005 | Koning et al. |
| 6,863,236 | B2 | 3/2005 | Kempf et al. |
| 6,868,585 | B2 | 3/2005 | Anthony et al. |
| 6,868,591 | B2 | 3/2005 | Dingman et al. |
| 6,871,876 | B2 | 3/2005 | Xu |
| 6,874,819 | B2 | 4/2005 | O'Neill |
| 6,882,914 | B2 | 4/2005 | Gioutsos et al. |
| 6,886,889 | B2 | 5/2005 | Vits et al. |
| 6,896,291 | B1 | 5/2005 | Peterson |
| 6,902,193 | B2 | 6/2005 | Kim et al. |
| 6,913,288 | B2 | 7/2005 | Schulz et al. |
| 6,916,045 | B2 | 7/2005 | Clancy, III et al. |
| 6,921,136 | B2 | 7/2005 | Bell et al. |
| 6,922,875 | B2 | 8/2005 | Sato et al. |
| 6,931,669 | B2 | 8/2005 | Ashline |
| 6,935,701 | B1 | 8/2005 | Arnold et al. |
| 6,951,350 | B2 | 10/2005 | Heidorn et al. |
| 6,957,789 | B2 | 10/2005 | Bowman et al. |
| 6,959,946 | B2 | 11/2005 | Desmarais et al. |
| 6,962,394 | B2 | 11/2005 | Anthony et al. |
| 6,966,518 | B2 | 11/2005 | Kohlndorfer et al. |
| 6,969,022 | B2 | 11/2005 | Bell et al. |
| 6,969,122 | B2 | 11/2005 | Sachs et al. |
| 6,993,436 | B2 | 1/2006 | Specht et al. |
| 6,997,474 | B2 | 2/2006 | Midorikawa et al. |
| 6,997,479 | B2 | 2/2006 | Desmarais et al. |
| 7,010,836 | B2 | 3/2006 | Acton et al. |
| D519,406 | S | 4/2006 | Merrill et al. |
| 7,025,297 | B2 | 4/2006 | Bell et al. |
| 7,029,067 | B2 | 4/2006 | Vits et al. |
| 7,040,696 | B2 | 5/2006 | Vits et al. |
| 7,065,843 | B1 * | 6/2006 | Wu ..... 24/642 |
| 7,073,866 | B1 | 7/2006 | Berdahl |
| 7,077,475 | B2 | 7/2006 | Boyle |
| 7,080,856 | B2 | 7/2006 | Desmarais et al. |
| 7,083,147 | B2 | 8/2006 | Movsesian et al. |
| 7,100,991 | B2 | 9/2006 | Schroth et al. |
| 7,108,114 | B2 | 9/2006 | Mori et al. |
| 7,118,133 | B2 | 10/2006 | Bell et al. |
| 7,131,667 | B2 | 11/2006 | Bell et al. |
| 7,137,648 | B2 | 11/2006 | Schulz et al. |
| 7,137,650 | B2 | 11/2006 | Bell et al. |
| 7,140,571 | B2 | 11/2006 | Hishon et al. |
| 7,144,085 | B2 | 12/2006 | Vits et al. |
| 7,147,251 | B2 | 12/2006 | Bell et al. |
| D535,214 | S | 1/2007 | Kolasa |
| 7,159,285 | B2 | 1/2007 | Karlsson et al. |
| 7,180,258 | B2 | 2/2007 | Specht et al. |
| 7,182,370 | B2 | 2/2007 | Arnold |
| 7,210,707 | B2 | 5/2007 | Schroth et al. |
| 7,216,827 | B2 | 5/2007 | Tanaka et al. |
| 7,219,929 | B2 | 5/2007 | Bell et al. |
| 7,232,154 | B2 | 6/2007 | Desmarais et al. |
| 7,237,741 | B2 | 7/2007 | Specht et al. |
| 7,240,405 | B2 | 7/2007 | Webber et al. |
| 7,240,924 | B2 | 7/2007 | Kohlndorfer et al. |
| 7,246,854 | B2 | 7/2007 | Dingman et al. |
| 7,263,750 | B2 | 9/2007 | Keene et al. |
| 7,278,684 | B2 | 10/2007 | Boyle |
| D555,358 | S | 11/2007 | King |
| 7,300,013 | B2 | 11/2007 | Morgan et al. |
| 7,341,216 | B2 | 3/2008 | Heckmayr et al. |
| 7,360,287 | B2 | 4/2008 | Cerruti et al. |
| 7,367,590 | B2 | 5/2008 | Koning et al. |
| 7,377,464 | B2 | 5/2008 | Morgan |
| 7,384,014 | B2 | 6/2008 | Ver Hoven et al. |
| 7,395,585 | B2 | 7/2008 | Longley et al. |
| 7,404,239 | B1 | 7/2008 | Walton et al. |
| 7,407,193 | B2 | 8/2008 | Yamaguchi et al. |
| D578,931 | S | 10/2008 | Toltzman et al. |
| 7,452,003 | B2 | 11/2008 | Bell |
| 7,455,256 | B2 | 11/2008 | Morgan |
| 7,461,866 | B2 | 12/2008 | Desmarais et al. |
| 7,475,840 | B2 | 1/2009 | Heckmayr |
| 7,477,139 | B1 | 1/2009 | Cuevas |
| 7,481,399 | B2 | 1/2009 | Nohren et al. |
| 7,506,413 | B2 | 3/2009 | Dingman et al. |
| 7,516,808 | B2 | 4/2009 | Tanaka |
| 7,520,036 | B1 | 4/2009 | Baldwin et al. |
| D592,543 | S | 5/2009 | Kolasa |
| D592,830 | S | 5/2009 | Whiteside |
| 7,533,902 | B2 | 5/2009 | Arnold et al. |
| 7,547,043 | B2 | 6/2009 | Kokeguchi et al. |
| 7,614,124 | B2 | 11/2009 | Keene et al. |
| 7,631,830 | B2 | 12/2009 | Boelstler et al. |
| 7,669,794 | B2 | 3/2010 | Boelstler et al. |
| 7,673,945 | B1 | 3/2010 | Riffel et al. |
| 7,698,791 | B2 | 4/2010 | Pezza |
| 7,716,794 | B2 * | 5/2010 | Wu ..... 24/579.11 |
| 7,722,081 | B2 | 5/2010 | Van Druff et al. |
| 7,739,019 | B2 | 6/2010 | Robert et al. |
| 7,753,410 | B2 | 7/2010 | Coultrup |
| 7,775,557 | B2 | 8/2010 | Bostrom et al. |
| RE41,790 | E | 10/2010 | Stanley |
| 7,861,341 | B2 | 1/2011 | Ayette et al. |
| 7,862,124 | B2 | 1/2011 | Dingman |

(56) References Cited

U.S. PATENT DOCUMENTS

| | | | | |
|---|---|---|---|---|
| D632,611 | S | 2/2011 | Buscart | |
| D637,518 | S | 5/2011 | Chen | |
| 7,934,775 | B2 | 5/2011 | Walker et al. | |
| 7,945,975 | B2 | 5/2011 | Thomas et al. | |
| 8,011,730 | B2 | 9/2011 | Greenwood | |
| 8,037,581 | B2 | 10/2011 | Gray et al. | |
| 8,096,027 | B2 | 1/2012 | Jung et al. | |
| 8,240,012 | B2 | 8/2012 | Walega et al. | |
| 8,240,767 | B2 | 8/2012 | Greenwood | |
| 8,387,216 | B1 | 3/2013 | Martinson | |
| 8,468,660 | B2 * | 6/2013 | Holler | 24/632 |
| 8,567,022 | B2 | 10/2013 | Keene et al. | |
| 8,627,554 | B1 | 1/2014 | Hagan et al. | |
| 2002/0089163 | A1 | 7/2002 | Bedewi et al. | |
| 2002/0135175 | A1 | 9/2002 | Schroth | |
| 2002/0145279 | A1 | 10/2002 | Murray | |
| 2003/0015863 | A1 | 1/2003 | Brown et al. | |
| 2003/0027917 | A1 | 2/2003 | Namiki et al. | |
| 2003/0085608 | A1 | 5/2003 | Girardin | |
| 2004/0084953 | A1 | 5/2004 | Hansen | |
| 2004/0169411 | A1 | 9/2004 | Murray | |
| 2004/0174063 | A1 | 9/2004 | Kocher | |
| 2004/0217583 | A1 | 11/2004 | Wang | |
| 2004/0227390 | A1 | 11/2004 | Schroth | |
| 2004/0251367 | A1 | 12/2004 | Suzuki et al. | |
| 2005/0073187 | A1 | 4/2005 | Frank et al. | |
| 2005/0107932 | A1 | 5/2005 | Bolz et al. | |
| 2005/0127660 | A1 | 6/2005 | Liu | |
| 2005/0175253 | A1 | 8/2005 | Li et al. | |
| 2005/0179244 | A1 | 8/2005 | Schroth | |
| 2005/0206151 | A1 | 9/2005 | Ashline | |
| 2005/0284977 | A1 | 12/2005 | Specht et al. | |
| 2006/0071535 | A1 | 4/2006 | Kim et al. | |
| 2006/0075609 | A1 | 4/2006 | Dingman et al. | |
| 2006/0097095 | A1 | 5/2006 | Boast | |
| 2006/0237573 | A1 | 10/2006 | Boelstler et al. | |
| 2006/0243070 | A1 | 11/2006 | Van Druff et al. | |
| 2006/0267394 | A1 | 11/2006 | David et al. | |
| 2006/0277727 | A1 | 12/2006 | Keene et al. | |
| 2007/0080528 | A1 | 4/2007 | Itoga et al. | |
| 2007/0241549 | A1 | 10/2007 | Boelstler et al. | |
| 2007/0257480 | A1 | 11/2007 | Van Druff et al. | |
| 2008/0018156 | A1 | 1/2008 | Hammarskjold et al. | |
| 2008/0054615 | A1 | 3/2008 | Coultrup | |
| 2008/0093833 | A1 | 4/2008 | Odate | |
| 2008/0100051 | A1 | 5/2008 | Bell et al. | |
| 2008/0100122 | A1 | 5/2008 | Bell et al. | |
| 2008/0136246 | A1 | 6/2008 | Salter | |
| 2008/0172847 | A1 | 7/2008 | Keene et al. | |
| 2008/0224460 | A1 | 9/2008 | Erez | |
| 2009/0014991 | A1 | 1/2009 | Smyth et al. | |
| 2009/0069983 | A1 | 3/2009 | Humbert et al. | |
| 2009/0179412 | A1 | 7/2009 | Gray et al. | |
| 2009/0183348 | A1 | 7/2009 | Walton et al. | |
| 2009/0212549 | A1 | 8/2009 | Jones | |
| 2009/0241305 | A1 | 10/2009 | Buckingham | |
| 2010/0046843 | A1 | 2/2010 | Ma et al. | |
| 2010/0115737 | A1 | 5/2010 | Foubert | |
| 2010/0125983 | A1 | 5/2010 | Keene et al. | |
| 2010/0146749 | A1 | 6/2010 | Jung | |
| 2010/0213753 | A1 | 8/2010 | Humbert | |
| 2010/0219667 | A1 | 9/2010 | Merrill et al. | |
| 2011/0010901 | A1 | 1/2011 | Holler | |
| 2011/0043402 | A1 | 2/2011 | Sasakawa | |
| 2011/0057500 | A1 | 3/2011 | Walker et al. | |
| 2011/0162175 | A1 * | 7/2011 | Gnesda et al. | 24/593.1 |
| 2012/0242134 | A1 | 9/2012 | Siegel | |
| 2012/0284966 | A1 * | 11/2012 | Greaves et al. | 24/170 |
| 2012/0292893 | A1 | 11/2012 | Baca et al. | |
| 2013/0127229 | A1 | 5/2013 | Humbert | |
| 2013/0212845 | A1 * | 8/2013 | Ford et al. | 24/602 |

FOREIGN PATENT DOCUMENTS

| | | |
|---|---|---|
| CA | 2112960 | 7/1994 |
| CA | 2450744 | 2/2003 |
| DE | 4019402 | 12/1991 |
| DE | 4421688 | 12/1995 |
| DE | 69019765 | 2/1996 |
| EP | 26564 | 4/1981 |
| EP | 0363062 | 4/1990 |
| EP | 0380442 | 8/1990 |
| EP | 0401455 | 12/1990 |
| EP | 0404730 | 12/1990 |
| EP | 0449772 | 10/1991 |
| EP | 0519296 | 12/1992 |
| EP | 0561274 | 9/1993 |
| EP | 0608564 | 8/1994 |
| EP | 1153789 | 11/2001 |
| EP | 1447021 | 8/2004 |
| FR | 1298012 | 7/1962 |
| GB | 888436 | 1/1962 |
| GB | 1047761 | 11/1966 |
| GB | 1582973 | 1/1981 |
| GB | 2055952 | 3/1981 |
| GB | 2356890 | 6/2001 |
| JP | 52055120 | 5/1977 |
| JP | 63141852 U | 9/1988 |
| JP | 63247150 | 10/1988 |
| JP | 10119611 | 5/1998 |
| JP | 2001138858 | 5/2001 |
| WO | WO-8603386 | 6/1986 |
| WO | WO-03009717 | 2/2003 |
| WO | WO-2004004507 | 1/2004 |
| WO | WO-2006041859 | 4/2006 |
| WO | WO-2010/027853 | 3/2010 |

OTHER PUBLICATIONS

Global Seating Systems LLC, "CCOPS," Cobra: Soldier Survival System, 1 page, undated. [Color Copy].

Holmbergs, "Art.no. 63/4959-XX and 63-4958-XX GR.1 Buckle, 3/5 point." Accessed Sep. 15, 2010. www.holmbergs.se. (2 pages).

Holmbergs, "Gr. 0+ 3-point buckle with plastic chassi and tongues." Accessed Sep. 15, 2010. www. holmbergs.se. (1 page).

Holmbergs, "Gr. 1 Buckle, Viking." Accessed Sep. 15, 2010. www. holmbergs.se. (1 page).

Holmbergs, "Group 1 Systems." Accessed Sep. 15, 2010. www. holmbergs.se. (1 page).

Holmbergs, "Infant buckle with steel tongues." Accessed Sep. 15, 2010. www.holmbergs.se. (1 page).

Holmbergs, "Infant buckle. 5-point with plastic chassi and plastic tongues." Accessed Sep. 15, 2010. www.holmbergs.se. (1 page).

Novarace, "DL: Group 1 Buckle." Accessed Sep. 15, 2010. www. novarace.com. (1 page).

Novarace, "GT 3: Group 0 Buckle." Accessed Sep. 15, 2010. www. novarace.com (1 page).

Novarace, "GT 5: Group 0 Buckle." Accessed Sep. 15, 2010. www. novarace.com (1 page).

Novarace, "GT: Group 1 Buckle." Accessed Oct. 8, 2010. www. novarace.com. (1 page).

Novarace, "KMA 1: Group 1 Buckle." Accessed Sep. 15, 2010. www.novarace.com. (1 page).

Sabelt Catalog, "SAB104: Standard tongue hole to facilitate webbing insert," p. 23 (1 page).

Sabelt, "Daphne 0: Fiberglass-plastic buckle with metal pin latch." Accessed Sep. 15, 2010. www.sabelt.com (1 page).

Sabelt, "RO1000: Fiberglass-plastic buckle with metal pin latch." Accessed Sep. 15, 2010. www.sabelt.com (1 page).

Sabelt, "SAB004: Fiberglass-plastic buckle with metal pin latch." Accessed Sep. 15, 2010. www. sabelt.com. (1 page).

Sabelt, "SABUSA004: Fiberglass-plastic buckle with metal pin latch." Accessed Sep. 15, 2010. www.sabelt.com. (1 page).

Schroth Safety Products, Installation Instructions, HMMWV Gunner restraint, Single Lower with Swivel—M1151, Revision: A, Jul. 28, 2006, pp. 1-10.

(56) References Cited

OTHER PUBLICATIONS

Toltzman, Randall and Shaul, Rich; "Buckle Assembly"; U.S. Appl. No. 29/297,210, filed Nov. 6, 2007.
ExxonMObil Santoprene 221-55 Thermoplastic Elastomer materials sheet. Retrieved from http://www.matweb.com/search/datasheet.aspx?matguid=67de0de851854bb085afcfac35e294f5&ckck=1 on Jul. 8, 2013.
ASTM D395-03 (Reapproved 2008) "Standard Test Methods for Rubber Property—Compression Set", Retreived from http://enterprise2.astm.org/DOWNLOAD/D395.1656713-1.pdf on Jul. 9, 2013.

* cited by examiner

DUAL RELEASE BUCKLE ASSEMBLIES AND ASSOCIATED SYSTEMS AND METHODS

CROSS-REFERENCE TO RELATED APPLICATION

The present application claims the benefit under 35 U.S.C. §119(e) of U.S. Provisional Patent Application No. 61/766,683 filed Feb. 19, 2013, titled "DUAL RELEASE BUCKLE ASSEMBLIES AND ASSOCIATED SYSTEMS AND METHODS." The above mentioned application is incorporated herein by reference in its entirety.

TECHNICAL FIELD

The following disclosure relates generally to personal restraint systems for use in vehicles and, more particularly, to buckle assemblies having dual release features and associated methods and systems.

BACKGROUND

There are many types of personal restraint systems for use in automobiles, aircraft, all-terrain vehicles, and other vehicles. Such systems include, for example, seat belts for use by adults and children of sufficient sizes, and child seats with associated restraints for use by toddlers and small children. Methods of securing seat belts or webs around an occupant on a vehicle or an aircraft include releasably attaching an end portion of each of the belts or webs to a buckle assembly. The buckle assembly retains the belts or webs around the occupant so as to secure the occupant on a seat of the vehicle or aircraft. The occupant can release the belts or webs from the buckle assembly when he or she wants to leave the seat.

Conventional buckle assemblies for use in personal restraint systems typically connect with one or more webs or belts to restrain occupants or passengers in their seats. For example, a "three-point" harness system, as typically found in conventional automobiles, can include a shoulder web and a lap web that are releasably secured to a buckle assembly positioned proximate to the occupant's lower body. A "five-point" harness system can include a crotch web, first and second shoulder webs, and first and second lap webs that are releasably secured to a buckle assembly positioned proximate to the occupant's mid-section. Conventional buckle assemblies for such five-point harnesses include a push button or rotary-style release feature to disengage the webs from the buckle assembly. However, especially under certain emergency circumstances, releasing the buckle assembly by rotation or pushing buttons can be difficult for some occupants.

DETAILED DESCRIPTION

The following disclosure describes dual release buckle assemblies and associated systems and methods. Advantages of embodiments of the buckle assemblies described in the present disclosure include improving safety for occupants in vehicles by providing more than one way to release the buckle assemblies. Other advantages of embodiments of the present disclosure include providing a relatively easy and quick way to release the buckle assembly by a simple action of the occupant.

As described in greater detail below, a personal restraint system configured in accordance with one aspect of the disclosure can include a secondary or dual release buckle assembly. Certain details are set forth in the following description and in FIGS. 1-4 to provide a thorough understanding of various embodiments of the present disclosure. However, other details describing well-known structures and systems often associated with buckle assemblies and/or other aspects of personal restraint systems are not set forth below to avoid unnecessarily obscuring the description of various embodiments of the present disclosure.

Many of the details, dimensions, angles, and other features shown in the Figures are merely illustrative of particular embodiments of the disclosure. Accordingly, other embodiments can have other details, dimensions, angles, and features without departing from the scope of the present disclosure. In addition, those of ordinary skill in the art will appreciate that further embodiments of the present disclosure can be practiced without several of the details described below. In the Figures, identical reference numbers identify identical or at least generally similar elements.

Figure 1:
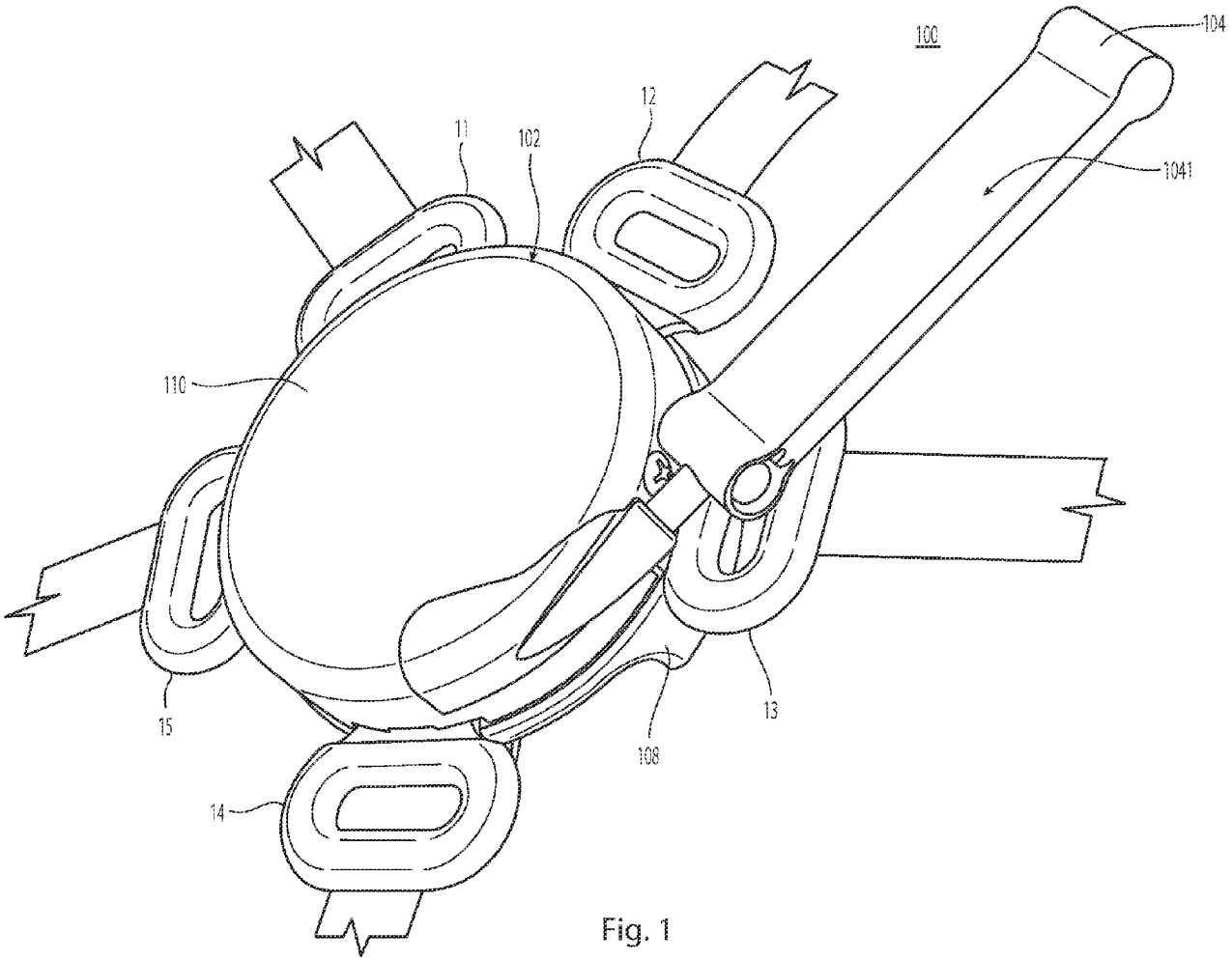
FIG. 1 is an isometric view of a portion of a personal restraint system having a buckle assembly configured in accordance with an embodiment of the present disclosure.

FIG. 1 is an isometric view of a portion of a personal restraint system 100 in accordance with an embodiment of the present disclosure. As shown in FIG. 1, the personal restraint system 100 includes a buckle assembly 102 and a plurality of (e.g., five) latch plates (or seat belt connectors) 11, 12, 13, 14, and 15. The buckle assembly 102 can further include a release cord 104, a cable 106, a top cover 108, and a bottom housing 110. In the illustrated embodiment, the buckle assembly 102 can receive and releasably engaged the latch plates 11-15, which further connect with suitable belts or webs of the personal restraint system 100. In other embodiments, the buckle assembly 102 can accommodate a different number of latch plates, depending on various designs and arrangements. One of ordinary skill in the art would know that the latch plates 11-15 can be inserted into the buckle assembly 102 in random order. In addition, the latch plates 11-15 can function independently without interfering with one another.

In the illustrated embodiment, the buckle assembly 102 includes a dual release feature. For example, an occupant in a vehicle can release the latch plates 11-15 from the buckle assembly 102 by either rotating the top cover 108 or by pulling the release cord 104 (see FIG. 4 below). In other embodiments, an occupant can release the latch plates 11-15 by either pushing a button located on the top cover 108 or by pulling the release cord 104. In the illustrated embodiment, the release cord 104 can include a gripping surface 1041 which provides sufficient contact area for the occupant to grasp and pull the release cord 104 during operation. In other embodiments, the release cord 104 can be formed in other suitable shapes, handles, features etc. or have certain surface treatments (e.g., increasing the surface friction), depending on the occupant's capability (e.g., a toddler occupant) or personal preference of holding the release cord 104.

Figure 2:
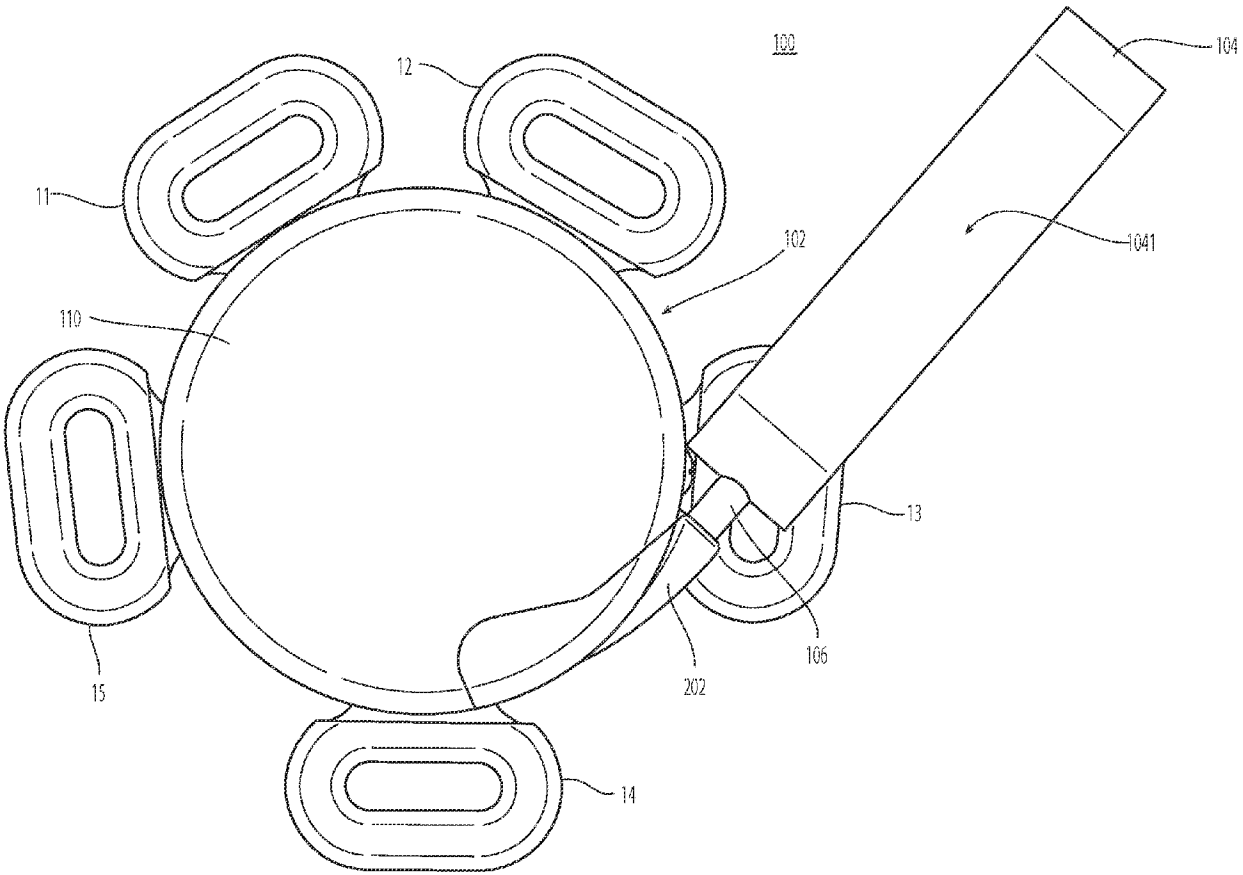
FIG. 2 is a top view of the buckle assembly of FIG. 1.

FIG. 2 is a top view of the buckle assembly 102 of FIG. 1. The buckle assembly 102 can include a receiving component 202 to accommodate the cable 106, or more specifically the cable housing or sleeve. In the illustrated embodiment, the receiving component 202 can be formed as a part of the top cover 108. In other embodiments, the receiving component 202 can be independently formed and subsequently attached to the top cover 108. In certain embodiments, the receiving component 202 can be formed as a part of the bottom housing 110. When an occupant pulls the release cord 104 to release one or more of the latch plates 11-15 inserted in the buckle assembly 102, the cable 106 can move smoothly outward from the receiving component 202.

Figure 3:
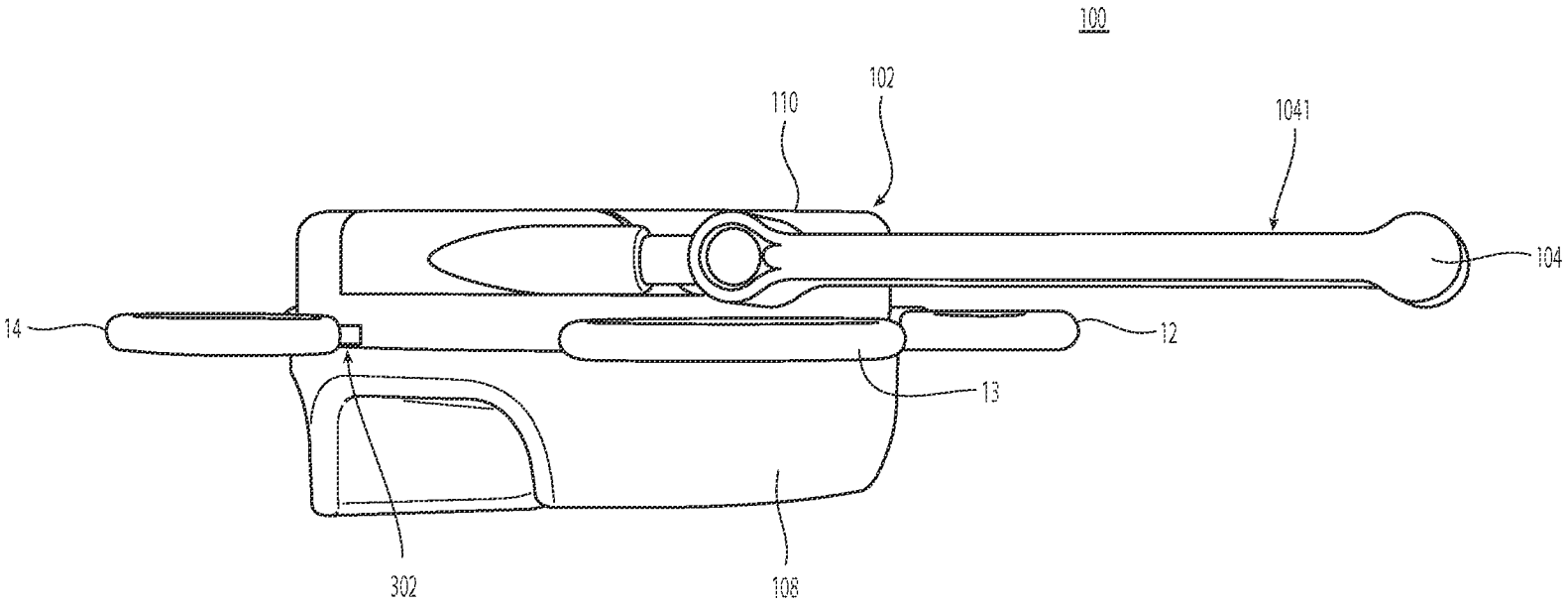
FIG. 3 is a side view of the buckle assembly FIG. 1.

FIG. 3 is a side view of the buckle assembly 102 of FIG. 1. In the illustrated embodiment, the buckle assembly 102 can be formed with five openings 302 (not all openings are shown in FIG. 3) for receiving the inserted latch plates 11-15. In other embodiments, the buckle assembly 102 can have a different number of openings, for example, depending on the number of latch plates to be inserted. In the illustrated embodiment, the openings 302 can be defined collectively by the top cover 108 and the bottom housing 110. In certain embodiments, the openings 302 can be formed and located in the top cover 108. In other embodiments, the openings 302 can be formed and located in the bottom housing 110.

Figure 4:
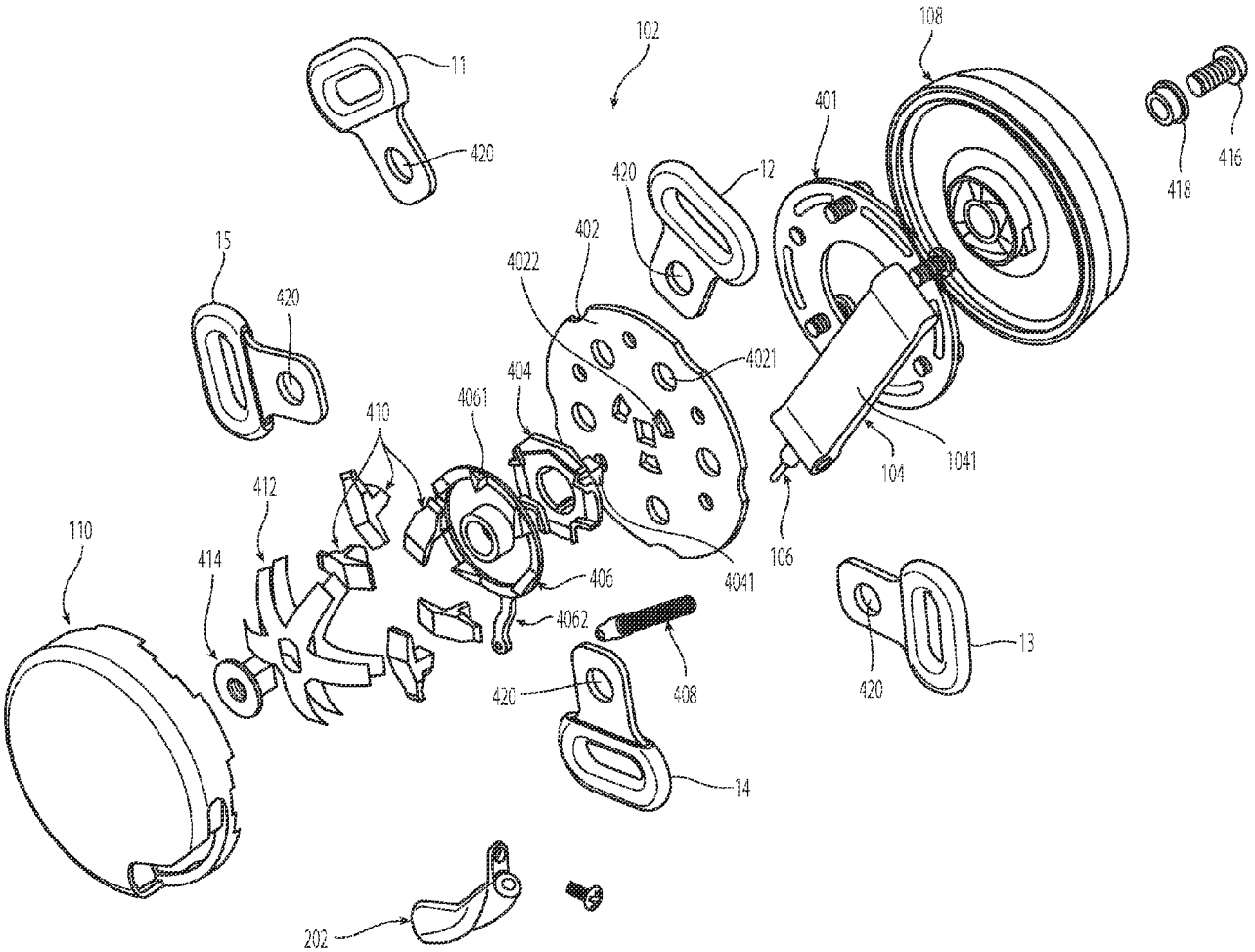
FIG. 4 is an exploded isometric view of the buckle assembly shown in FIG. 1.

FIG. 4 is an exploded isometric view of the buckle assembly 102 shown in FIG. 1. In the illustrated embodiment, the buckle assembly 102 includes an upper plate 401, a load plate 402, an actuator 404, a release ring 406, a cable spring 408, latch pawls 410, a pawl spring 412, a shoulder nut 414, a center screw 416, and a bushing 418. The top cover 108, the load plate 402, and the bottom housing 110 can be coupled together and secured by the center screw 416. The bushing 418 can be positioned between the center screw 416 and the top cover 108 and function as a cushion. In certain embodiments, the bushing 418 can be positioned at other suitable places. In the illustrated embodiment, the upper plate 401 can be used to couple the load plate 402 to other components, such as the bottom housing 110 or the top cover 108, by bolts/screws and nuts, glue, wedges, or other suitable means.

As shown in FIG. 4, the load plate 402 can be formed with multiple load-plate apertures 4021 for receiving the pawls 410. In the illustrated embodiment, the latch plates 11-15 can include latch openings or apertures 420 for receiving and engaging the paws 410. When occupants want to be secured in their seats, they can insert the latch plates 11-15 to the openings 302 (FIG. 3), and then the latch apertures 420 will be aligned with the corresponding load-plate apertures 4021 respectively. Then the pawl spring (or springs) 412 can provide resilient forces to push or bias the paws 410 upwardly through the corresponding latch apertures 420 and load-plate apertures 4021 respectively, to engage and secure the latch plates 11-15. As a result, the occupants can be restrained or secured on their seats. In the illustrated embodiment, the paw spring 412 can be spring steel and can be supported by the shoulder nut 414, which can be positioned between the pawl spring 412 and the bottom housing 110.

When occupants want to be released from their seats, the buckle assembly 102 of the present disclosure offers them two options. The first option is that the occupants can rotate the top cover 108, which is operably coupled to the actuator 404 (e.g., via the center screw 416). As shown in FIG. 4, the actuator 404 includes at least one protrusion 4041 configured to extend through a corresponding opening 4022 in the load plate 402 and cooperate with the top cover 108. When the occupant rotates the top cover 108, the actuator 404 pushes the pawls 410 back toward the bottom housing 110. As a result, the pawls 410 move out of the corresponding latch apertures 420 and load-plate apertures 4021, releasing the latch plates 11-15 and allowing them to be withdrawn from the buckle assembly 102. In other embodiments, the occupants in vehicles can push a bottom (not shown) on the top cover 108 to cause the same effect as discussed above to release the inserted latch plates 11-15.

The second option for releasing the latch plates is that the occupant can pull or move the release cord 104 away from the buckle assembly 102. As shown in FIG. 4, the release cord 104 is attached to the release ring 406 via the cable 106 and the cable spring 408. In the illustrated embodiment, the release ring 406 can include multiple angled cam surfaces on protrusions 4061 corresponding to individual pawls 410. When the occupants pull the release cord 104, the release ring 406 rotates so that the protrusions 4061 push all the pawls 410 back toward the bottom housing 110 at the same time. As a result, the pawls 410 retreat from the corresponding latch apertures 420 and load-plate apertures 4021, releasing the inserted latch plates 11-15. Once the occupant is released from his seat and lets go of the release cord 104, the cable spring 408 can provide a resilient force to bias the release cord 104 back to its initial position (as shown in FIGS. 1-3).

In the illustrated embodiment, the release ring 406 can include an attaching portion 4062 configured to attach to an end portion of the cable spring 408. In certain embodiments, the attaching portion 4062 can attach with the cable 106 directly. As shown in FIG. 4, the attaching portion 4062 can connect to the cable spring 408 by a bolt/screw and a nut. In other embodiments, the attaching component 4062 and the cable spring 408 can be connected by any other suitable means.

In the illustrated embodiment, the receiving component 202 receives the cable spring 408 and the cable 106 and protects the same from damages caused by accidental impacts. The receiving component 202 also provides a guide for the cable 106 and the cable spring 408 during their movement. In certain embodiments, the receiving component 202 can be attached to the bottom housing 110 by a bolt/screw and a nut. In other embodiments, the receiving component 202 can be formed as an integral with the bottom housing 110. In certain embodiments, the receiving component 202 can be attached to or integrally formed with the top cover 108.

The buckle assembly 102 described in the present disclosure can be connected with a computer system (not shown) of a vehicle. In certain embodiments, the computer system of the vehicle can monitor the status of the buckle assembly 102 (e.g., whether the inserted latch plates are secured properly) and takes actions accordingly. For example, when the computer system detects an abnormal situation (e.g., an unexpected impact), the system can notify the occupant who is currently using the buckle assembly, or alternatively, the system can automatically lock or release the buckle assembly. The computer system described in the present disclosure can include a center processing unit (CPU) configured to process a set of computer readable instructions, a memory configured to temporarily store the same instructions, and a storage device configured to store the same instructions and other related information.

From the foregoing, it will be appreciated that specific embodiments of the disclosure have been described herein for purposes of illustration, but that various modifications may be made without deviating from the spirit and scope of the various embodiments of the disclosure. Further, while various advantages associated with certain embodiments of the disclosure have been described above in the context of those embodiments, other embodiments may also exhibit such advantages, and not all embodiments need necessarily exhibit such advantages to fall within the scope of the invention. The following examples are directed to embodiments of the present disclosure.

The invention claimed is:

1. A buckle assembly, comprising:

a top cover;

a bottom housing connected to the top cover, wherein the top cover and the bottom housing collectively define an internal space;

an actuator positioned in the internal space and operably coupled to the top cover;

a load plate positioned in the internal space and having a plurality of apertures;

a plurality of pawls, wherein each of the pawls is configured to operably extend through a corresponding one of the apertures so as to secure a corresponding latch plate coupled to a web of a personal restraint system;

a release ring rotatably positioned in the internal space adjacent to the pawls; and a release cord positioned outside the internal space and coupled to the release ring, wherein the release cord includes a gripping surface providing a contact area for an occupant to grasp and pull the release cord;

wherein, when the top cover is rotated, the actuator moves the pawls out from the corresponding apertures, so as to release the corresponding latch plates, and wherein, when the release ring is rotated, the release ring moves the pawls out from the corresponding apertures, so as to release the corresponding latch plates.

2. A buckle assembly, comprising:

a top cover;

a bottom housing connected to the top cover, wherein the top cover and the bottom housing collectively define an internal space;

an actuator positioned in the internal space and operably coupled to the top cover;

a load plate positioned in the internal space and having a plurality of apertures;

a plurality of pawls, wherein each of the pawls is configured to operably extend through a corresponding one of the apertures so as to secure a corresponding latch plate coupled to a web of a personal restraint system;

a release ring rotatably positioned in the internal space adjacent to the pawls; and a pawl spring including a base portion and a plurality of end portions, wherein the end portions extend radially outward from the base portion, and wherein each of the end portions biases a corresponding one of the pawls toward the corresponding one of the apertures;

wherein, when the top cover is rotated, the actuator moves the pawls out from the corresponding apertures, so as to release the corresponding latch plates; and wherein, when the release ring is rotated, the release ring moves the pawls out from the corresponding apertures, so as to release the corresponding latch plates.

3. The buckle assembly of claim 2, wherein the actuator includes a protrusion, and wherein the load plate includes an opening configured to operably receive at least a portion of the protrusion.

4. The buckle assembly of claim 2, wherein the release ring includes an attaching portion configured to attach to a release cord positioned outside the internal space.

5. The buckle assembly of claim 4, wherein the attaching portion is attached to the release cord via a cable spring and a cable.

6. A buckle assembly, comprising:

a top cover;

a bottom housing connected to the top cover, wherein the top cover and the bottom housing collectively define an internal space;

a load plate positioned in the internal space and having a plurality of apertures;

a plurality of pawls positioned in the internal space, wherein each of the pawls is configured to operably extend through a corresponding one of the apertures so as to secure a corresponding latch plate coupled to a web of a personal restraint system;

a release ring rotatably positioned in the internal space adjacent to the pawls; and a release cord positioned outside the internal space and coupled to the release ring;

wherein, when the top cover is rotated, the pawls are moved out from the corresponding apertures, so as to release the corresponding latch plates; and wherein, when the release cord is pulled, the release ring moves the pawls out from the corresponding apertures, so as to release the corresponding latch plates.

7. The buckle assembly of claim 6, wherein the apertures are positioned circumferentially around the load plate.

8. The buckle assembly of claim 6, further comprising:

a receiving component positioned adjacent to the bottom housing and configured to receive a cable; and a cable spring positioned inside the receiving component and coupled to the cable, wherein the cable spring provides a biasing force to maintain the release cord at an initial position.

9. The buckle assembly of claim 8, wherein the cable spring includes an end portion, and wherein the release ring includes an attaching portion configured to couple to the end portion.

10. The buckle assembly of claim 8, wherein the receiving component is formed as a part of the top cover.

11. The buckle assembly of claim 8, wherein the receiving component is independently formed and attached to the top cover.

12. The buckle assembly of claim 6, wherein the release ring includes a plurality of protrusions corresponding to the pawls, wherein the protrusions are configured to operably push the pawls toward the bottom housing when the top cover is rotated or when the release cord is pulled.

* * * * *